US005670740A

United States Patent [19]

Barnes et al.

[11] Patent Number: 5,670,740

[45] Date of Patent: *Sep. 23, 1997

[54] HETEROGENEOUS GAS GENERANT CHARGES

[75] Inventors: Michael W. Barnes, Brigham City; Robert D. Taylor, Hyrum; Christopher Hock, Uintah; Michael P. Jordan, South Weber; Matthew A. Cox, Bountiful; Alan J. Ward, North Ogden, all of Utah

[73] Assignee: Morton International, Inc., Chicago, Ill.

[ * ] Notice: The term of this patent shall not extend beyond the expiration date of Pat. No. 5,467,715.

[21] Appl. No.: 540,379

[22] Filed: Oct. 6, 1995

[51] Int. Cl.[6] ..... C06B 31/12

[52] U.S. Cl. ..... 149/62; 149/92; 149/78; 149/15; 102/289; 102/290

[58] Field of Search ..... 149/45, 61, 62, 149/77, 78, 92, 14, 15; 102/289, 287, 290

[56] References Cited

U.S. PATENT DOCUMENTS

| | | | |
|---|---|---|---|
| 3,785,149 | 1/1974 | Timmerman | 149/83 |
| 5,015,309 | 5/1991 | Wardle et al. | 149/61 |
| 5,035,757 | 7/1991 | Poole | 149/46 |
| 5,084,218 | 1/1992 | Vos et al. | 264/3.4 |
| 5,431,103 | 7/1995 | Hock et al. | 102/287 |
| 5,467,715 | 11/1995 | Taylor et al. | 102/289 |
| 5,531,941 | 7/1996 | Poole | 264/3.4 |
| 5,547,528 | 8/1996 | Erickson et al. | 149/92 |

*Primary Examiner*—Christine Skane
*Assistant Examiner*—John R. Hardee
*Attorney, Agent, or Firm*—Wayne E. Nacker; Gerald K. White

[57] ABSTRACT

A gas generant charge comprises a heterogeneous mixture of between about 80 and about 95 wt % of a first gas generant composition 1) and between about 5 and about 20 wt % of a second gas generant composition 2), based on the total weight of 1) plus 2). The first gas generant composition 1) comprises between about 20 and about 40 wt % fuel A) and between about 20 and about 60 wt % oxidizer B). Between about 50 and about 85 wt % of the fuel A) is a triazole or tetrazole compound $A^1$), and between about 15 and about 50 wt % of the fuel is, a water-soluble fuel $A^2$). At least about 20 wt % of the oxidizer B), up to 100%, a transition metal oxide $B^1$); balance of the oxidizer is selected from the group $B^2$) consisting of alkali and/or alkaline earth metal nitrates, chlorates or perchlorates. The second gas generant composition 2) comprises between about 30 and about 65 wt % of a fuel C) which is an organic compound containing only the elements carbon, hydrogen, and oxygen, the oxygen content being between about 35 and about 65 wt % of the organic compound, and an between about 35 and about 70 wt % of an oxidizer D) which is selected from the group consisting of alkali metal chlorates, alkali metal perchlorates, and mixtures thereof. The mixed generant charge produces less undesirable gases than the first gas generant composition alone and less particulate matter than the second gas generant composition alone.

8 Claims, No Drawings

HETEROGENEOUS GAS GENERANT CHARGES

The present Invention is directed to gas generant compositions for inflating automotive air-bags and other devices in which rapid production of high volumes of gas is required. More particularly, the invention is directed a gas generant charge which is a heterogeneous mixture of two types of gas generant compositions. The gas generant compositions of the heterogeneous mixture complement each other, producing combustion products which are both low in undesirable gases and low in particulate matter.

BACKGROUND OF THE INVENTION

Most automotive air bag restraint systems, presently in use, use gas generant compositions in which sodium azide is the principal fuel. Because of disadvantages with sodium azide, particularly instability in the presence of metallic impurities and toxicity, which presents a disposal problem for un-fired gas generators, there is a desire to develop non-azide gas generant systems, and a number of non-azide formulations have been proposed. However, to date, non-azide gas generants have not made significant commercial inroads.

Alternatives to azides which have been proposed, e.g., in U.S. Pat. No. 5,035,757, the teachings of which are incorporated herein by reference, include azole compounds, including tetrazole and triazole compounds. Tetrazole compounds include 5-amino tetrazole (AT), tetrazole, bitetrazole and metal salts of these compounds. Triazole compounds include 1,2,4-triazole-5-one, 3-nitro 1,2,4-triazole-5-one and metal salts of these compounds. Although all of the above azole compounds are useful fuels in accordance with the present invention, AT is the most commercially important of these.

Gas generant systems include, in addition to the fuel component, an oxidizer. Proposed oxidizers for use in conjunction with azole fuels include alkali and alkaline earth metal salts of nitrates, chlorates and perchlorates.

Several gas generant processing procedures utilize water. Water-processing reduces hazards of processing gas generant materials. It is therefore desirable that gas generant compositions be formulated so as to facilitate water processing.

One Example of water processing, taught, e.g., in U.S. Pat. No. 5,015,309, the teachings of which are incorporated by reference, involves the steps of 1. Forming a slurry of the generant ingredients with water.
2. Spray drying the slurry to form spherical prills of diameter 100–300 microns.
3. Feeding the prills via gravity flow to a high speed rotary press.

In order to properly feed the tablet press, one needs well formed spherical prills. Without prills, plugging or bridging in the feed system is a common occurrence. Without prills, it is difficult to achieve uniform, high speed filling of the tablet press. These prills will not form in the spray drying step without at least a portion of the generant being water soluble. Typical slurries contain up to 35% water and it is preferred that at least 15% of the solid ingredients need to be soluble in the slurry.

Another common production technique, (e.g. U.S. Pat. No. 5,084,218), the teachings of which are incorporated herein by reference, involves the following steps:

1. Forming a slurry of the generant ingredients with water.

2. Extruding the slurry to form spaghetti like strands.
3. Chopping and spheronizing the strands into prills.
4. Tableting of the prills as described previously.

The chopping and spheronizing step to form prills will not be successful unless a portion of the generant is water soluble.

A problem encountered with gas generant compositions which utilize tetrazoles or triazoles as fuel is the production of undesirable gases, such as CO, $NO_x$, $NH_3$, and HCN. U.S. Pat. No. 5,467,715 issued 21 Nov. 1995 to Robert Taylor et al, now U.S. Pat. No. 5,467,715 the teachings of which are incorporated herein by reference, describes a gas generant composition which uses as fuel, in addition to a tetrazole or triazole, a water-soluble fuel, such as guanidine nitrate, and as the oxidizer, a transition metal oxide, plus, preferably, an additional oxidizer, such as strontium nitrate. This composition is aqueous-processable, and also minimizes levels of undesirable combustion gases. Nevertheless, the automotive industry is becoming increasingly sensitive to undesirable combustion gases and is imposing increasingly stricter standards. Thus, there is a continuing need to provide gas generant formulations producing further reduced levels of undesirable gases.

As described in U.S. Pat. No. 5,431,103, the teachings of which are incorporated herein by reference, the gas generant composition described in above-referenced U.S. Pat. No. 5,467,715 are auto-ignitable, auto-igniting, e.g., in the event of a vehicle fire, at a temperature substantially below temperatures where igniter housings, particularly aluminum igniter housings, weaken.

U.S. Pat. No. 3,785,149 issued 15 Jan. 1974 to Timmerman, the teachings of which are incorporated herein by reference, describes gas generant compositions which produce combustion gases which are substantially entirely carbon dioxide and water. The gas generant compositions of U.S. Pat. No. 3,785,149 use as the fuel an organic compound which contains only the elements carbon, hydrogen and oxygen, the organic compound being a compound containing carboxylic acid groups or carboxylic acid salt groups and therefore being high in oxygen content. The oxidizer is an alkali metal, preferably sodium or potassium, chlorate or perchlorate. One problem with this type of fuel is that it produces high levels of particulate material which appear as smoke in the interior of a vehicle when the airbag deploys. While such "smoke" may not be particularly harmful, it may cause an occupant of a vehicle or a rescuer to incorrectly believe that the vehicle is on fire. Another problem is poor compatibility with inflators formed of aluminum or containing aluminum parts. The high combustion temperatures of these gas generant compositions tends to destroy aluminum parts, e.g., burn holes through the inflator housing or filter pack.

SUMMARY OF THE INVENTION

A gas generant charge which provides low levels of undesirable gases and low levels of particulate matter upon combustion is a heterogeneous mixture of two gas generant compositions, the mixture comprising between about 80 and about 95 wt % of a first gas generant composition 1) and between about 5 and about 20 wt % of a second gas generant composition 2). The first gas generant composition 1) comprises between about 20 and about 40 wt % of fuel A) and between about 60 and about 80 wt % of oxidizer B). Between about 50 and about 85 wt % of the fuel A) is a triazole or tetrazole $A^1$) between about 15 and about 50 wt % of the fuel is a water-soluble fuel $A^2$) such as guanidine nitrate, ethylene diamine dinitrate or similar compounds. At least about 20 wt % of the oxidizer B) up to 100%, preferably at least about 50 wt %, comprises a transition metal oxide $B^1$); balance of the oxidizer $B^2$) alkali and/or alkaline earth metal nitrates, chlorates or perchlorates. The use of transition metal oxides as a major oxidizer component results in lower combustion temperatures, resulting in lower production of toxic oxides. The second gas generant composition 2) comprises between about 30 and about 65 wt % of a fuel C) which is an organic compound containing only the elements carbon, hydrogen, and oxygen, the oxygen content being between about 35 and about 65 wt % of the organic compound, and between about 35 and about 70 wt % of an oxidizer D) which is an alkali metalchlorate or perchlorate.

DETAILED DESCRIPTION OF CERTAIN REFERRED EMBODIMENTS

Herein, unless otherwise stated, all percentages are by weight. The weight percentage of each gas generant composition and its components are calculated relative to the active ingredients, i.e., the total of fuel and oxidizer components. The weight percentages of other ingredients, such as coolants, fillers, pressing aids, etc., are calculated relative to the total active ingredients of each gas generant composition, the total of oxidizer plus fuel being 100%.

While the major fuel component $A^1$) of the first gas generant composition 1) may be selected from any of the tetrazole and triazole compounds listed above and mixtures thereof; from an availability and cost standpoint, 5-aminotetrazole (AT) is presently the azole compound of choice. The purpose of the fuel is to produce carbon dioxide, water and nitrogen gases when burned with an appropriate oxidizer or oxidizer combination. The gases so produced are used to inflate an automobile gas bag or other such device. By way of example, AT is combusted to produce carbon dioxide, water and nitrogen according to the following equation:

$$2CH_3N_5+7/2O_2\rightarrow 2CO_2+3H_2O+5N_2.$$

To facilitate processing in conjunction with water, a minor portion of the first 1) fuel, i.e., between about 15 and about 50 wt % of the fuel, is a water soluble fuel $A^2$). While water-soluble oxidizers, such as strontium nitrate also facilitate water-processing, over-reliance on such water-soluble oxidizers tend to produce undesirably high combustion temperatures. Specific desirable characteristics of water-soluble fuels are:

- The compound should be readily soluble in water, i.e., at least about 30 gm/100 ml. $H_2O$ at 25° C.;
- The compound should contain only elements selected from H, C, O and N;
- When formulated with an oxidizer to stoichiometrically yield carbon dioxide, nitrogen, and water, the gas yield should be greater than about 1.8 moles of gas per 100 grams of formulation; and
- When formulated with an oxidizer to stoichiometrically yield carbon dioxide, water and nitrogen, the theoretical combustion temperature at 1000 psi should be low, preferably, less than about 1800° K.

Compounds that most ideally fit the above criteria are nitrate salts of amines or substituted amines. Suitable compounds include, but are not limited to, the group consisting of guanidine nitrate, aminoguanidine nitrate, diaminoguanidine nitrate, semicarbazide nitrate, triaminoguanidine nitrate, ethylenediamine dinitrate, hexamethylene tetramine dinitrate, and mixtures of such compounds. Guanidine nitrate is the currently preferred water-soluble fuel.

Generally any transition metal oxide will serve as an oxidizer $B^1$). Particularly suitable transition metal oxides include ferric oxide and cupric oxide. The preferred transition metal oxide is cupric oxide which, upon combustion of the gas generant, produces copper metal as a slag component. The purpose of the oxidizer is to provide the oxygen necessary to oxidize the fuel; for example, CuO oxidizes AT according to the following equation:

$$4CH_3N_5+14CuO\rightarrow 14Cu+4CO_2+6H_2O+10N_2.$$

The transition metal oxide $B^1$) may comprise the sole oxidizer in the first fuel or it may be used in conjunction with other oxidizers $B^2$) including alkali and alkaline earth metal nitrates, chlorates and perchlorates and mixtures of such oxidizers. Of these, nitrates (alkali and/or alkaline earth metal salts) are preferred, and strontium nitrate is currently most preferred. Nitrate oxidizers increase gas output slightly. Alkali metal nitrates are particularly useful as ignition promoting additives.

The first gas generant composition 1) may optionally contain a catalyst up to about 3 wt %, typically between about 1 and about 2 wt %. Boron hydrides and iron ferricyanide are such combustion catalysts. Certain transition metal oxides, such as copper chromate, chromium oxide and manganese oxide, in addition to the oxidizer function, further act to catalyze combustion.

To further reduce reaction temperature, coolants may also optionally be included in the first gas generant composition at up to about 10 wt %, typically between about 1 and about 5 wt %. Suitable coolants include graphite, alumina, silica, metal carbonate salts, transition metals and mixtures thereof. The coolants may be in particulate form, although if available, fiber form is preferred, e.g., graphite, alumina and alumina/silica fibers.

Suitable fuels C) for the second gas generant composition 2) include, but are not limited to oxalic acid, malonic acid, succinic acid, tartaric acid, mucic acid, citric acid, salts thereof and mixtures thereof. A currently preferred fuel is tartaric acid. Fuel compounds containing carboxylic acids are reactive with transition metal oxides; thus, the components of the first gas generant composition and second gas generant composition cannot be compounded together. Accordingly, the gas generant charges of the present invention must be heterogeneous.

The oxidizer D) for the second gas generant composition 2) is an alkali metal chlorate or perchlorate, particularly sodium chlorate, potassium chlorate, sodium perchlorate and potassium perchlorate.

As with the first gas generant composition, other ingredients known in the art, such as slag formers, processing aids, and/or burn rate catalysts may be optional or desirable in the second gas generant composition.

The first and second gas generant compositions are mutually beneficial when provided in a gas generant charge. The second gas generant composition reduces undesirable gases produced by the first gas generant composition. The first gas generant composition minimizes particulate matter produced by the second gas generant composition.

A heterogeneous charge may be provided in several manners. Powders of the two composition may be separately pressed into tablets or wafers and loaded into the inflator as two separate tablets or wafers. A "two headed" tablet can be manufactured of the two gas generant compositions by partial compaction of powders of one of the compositions, addition of powder of the second composition and final compaction for loading into the inflator as tablet or wafers. The currently preferred method is to dry blend powders of the two composition and press the dry-blended mixture into tablets or wafers. For producing tablets or wafers by any of the above methods, particularly the dry-blend method, it is preferred that the gas generant composition powders have particle sizes between about 25 and about 250 microns.

It is generally desirable to pelletize the gas generant composition. If so, up to about 1 wt %, typically 0.2–0.5 wt % of a pressing aid or binder may be employed. If the two generants are separately pelletized or tableted, binders or pressing aids will be added to each gas generant composition. If powders of the two generant compositions are pelletized or tableted together, the binder or pressing aid will be added to a mixture of powders of the two gas generant compositions. The binders or pressing agents may be selected from materials known to be useful for this purpose, including molybdenum disulfide, polycarbonate, graphite, Viton®, nitrocellulose, polysaccharides, polyvinylpyrrolidone, sodium silicate, calcium stearate, magnesium stearate, zinc stearate, talc, mica minerals, bentonite, montmorillonite and others known to those skilled in the art. A preferred pressing aid/binder is molybdenum disulfide. If molybdenum disulfide is used, it is preferred that an alkali metal nitrate be included as a portion of the oxidizer. Alkali metal nitrate in the presence of molybdenum disulfide results in the formation of alkali metal sulfate, rather than toxic sulfur species. Accordingly, if molybdenum disulfide is used, alkali metal nitrate is used as a portion of the oxidizer in an amount sufficient to convert substantially all of the sulfur component of the molybdenum disulfide to alkali metal sulfate. This amount is at least the stoichiometric equivalent of the molybdenum disulfide, but is typically several times the stoichiometric equivalent. On a weight basis, an alkali metal nitrate is typically used at between about 3 and about 5 times the weight of molybdenum disulfide used.

The invention will now be described in greater detail by way of specific examples.

COMPARATIVE EXAMPLES 1 AND 2; EXAMPLES 3 AND 4

A first gas generant composition is formulated as follows: 69.55 wt % cupric oxide, 19.45 wt % 5-aminotetrazole, 6 wt % guanidine nitrate, and 5 wt % strontium nitrate. A second gas generant composition is formulated with 59.08 wt % potassium perchlorate and 40.92 wt % tartaric acid. Each of these compositions was manufactured by charging a vessel with water sufficient to yield a 30 wt % slurry, adding the solid ingredients, and mixing with a high shear mixture. Each slurry was poured into a tray and dried in an oven at 85°–105° C. until the material was dry enough to be pressed through a 6 mesh screen. Drying was then completed.

The materials were each tableted on a high speed rotary tablet press, tablets being formed 0.25" in diameter, 0.07" thick.

Comparative Example 1 was the first gas generant composition alone. Comparative Example 2 is the second gas generant composition alone. Example 3 was a mixture 88 wt % of tablets of the first gas generant composition and 12 wt % of the second gas generant composition. Example 4 was tablets of a dry-blended mixture of the first and second gas generant compositions in the same weight percentages as Example 3.

Inflator tests using a 55 gram load exhausted into a 100 cubic foot tank are shown in the table below. Gas levels are given in parts per million by volume (ppm); particulate matter is expressed in grams.

| | Comparative Example 1 | Comparative Example 2** | Example 3 | Example 4 |
|---|---|---|---|---|
| $NO_x$ | 60–100 | N/A | 30–40 | 10–20 |
| Ammonia | 200–200 | N/A | 1–5 | 1–5 |
| HCN | 5–10 | N/A | 1–5 | 1–5 |
| Particulate | <0.5 | >2.0 | <0.5 | <0.5 |
| I.C.* | good | poor to unacceptable | fair | fair |

*Inflator compatibility

**In Comparative Example 2, only 25 grams of generant is used because higher loads result in excessively high pressures; particulate levels are calculated relative to a 55 gram charge.

It is seen that a mixture of the first and second gas generant compositions in Examples 3 and 4 produce significantly less undesirable gas than does the first gas generant composition (Comparative Example 1) alone, and less particulate matter then the second gas generant (Comparative Example 2) alone.

What is claimed is:

1. A gas generant charge comprising a heterogeneous mixture of between about 80 and about 95 wt % of a first gas generant composition 1) and between about 5 and about 20 wt % of a second gas generant composition 2), based on the total weight of 1) plus 2), said first gas generant composition 1) comprising between about 20 and about 40 wt % of fuel A) and between about 60 and about 80 wt % of oxidizer B), between about 50 and about 85 wt % of said fuel A) being a triazole or tetrazole compound $A^1$) between about 15 and about 50 wt % of said fuel being a water-soluble fuel $A^2$)

at least about 20 wt % of said oxidizer B), up to 100%, being a transition metal oxide $B^1$); balance of said oxidizer being selected from the group $B^2$) consisting of alkali and/or alkaline earth metal nitrates, chlorates or perchlorates, said second gas generant composition 2) comprising between about 30 and about 65 wt % of a fuel C) which is an organic compound having carboxylic acid functionality and containing only the elements carbon, hydrogen, and oxygen, the oxygen content being between about 35 and about 65 wt % of said organic compound, and between about 35 and about 70 wt % of an oxidizer D) which is selected from the group consisting of alkali metal chlorates, alkali metal perchlorates, and mixtures thereof.

2. A gas generant charge in accordance with claim 1 wherein said transition metal oxide is CuO.

3. A gas generant charge in accordance with claim 1 wherein said water soluble fuel is selected from the group consisting of guanidine nitrate, aminoguanidine nitrate, diaminoguanidine nitrate, semicarbazide nitrate, triaminoguanidine nitrate, ethylenediamine dinitrate, hexamethylene tetramine dinitrate, and mixtures thereof.

4. A gas generant charge in accordance with claim 3 wherein said water soluble fuel is guanidine nitrate.

5. A gas generant charge in accordance with claim 1 wherein said first and second gas generant compositions are pelletized in separate tablets or wafers.

6. A gas generant charge in accordance with claim 1 wherein said first and second gas generant composition are co-pelletized from a dry-blend mixture of said gas generant compositions.

7. A gas generant charge in accordance with claim 1 wherein said fuel C) of said second gas generant composition 2) is tartaric acid.

8. A gas generant charge in accordance with claim 1 wherein said oxidizer D) of said second gas generant composition 2) is potassium perchlorate.

* * * * *